US006222168B1

(12) United States Patent
Witonsky et al.

(10) Patent No.: US 6,222,168 B1
(45) Date of Patent: Apr. 24, 2001

(54) SHIELDING METHOD FOR MICROWAVE HEATING OF INFANT FORMULATE TO A SAFE AND UNIFORM TEMPERATURE

(75) Inventors: Robert J. Witonsky, Princeton; John W. Scarantino, Merceville, both of NJ (US)

(73) Assignee: Medical Indicators, Inc., West Trenton, NJ (US)

( * ) Notice: Subject to any disclaimer, the term of this patent is extended or adjusted under 35 U.S.C. 154(b) by 0 days.

(21) Appl. No.: 08/738,165

(22) Filed: Oct. 25, 1996

Related U.S. Application Data

(60) Provisional application No. 60/005,997, filed on Oct. 27, 1995.

(51) Int. Cl.[7] ..... H05B 6/80; H05B 6/68

(52) U.S. Cl. ..... 219/687; 219/710; 219/720; 219/729; 219/732; 426/88; 426/241; 116/216; 374/149; 99/DIG. 14

(58) Field of Search ..... 219/687, 689, 219/688, 710, 720, 729, 736, 732, 734, 745; 426/88, 234, 241, 243; 116/216; 374/149, 161; 99/DIG. 14

(56) References Cited

U.S. PATENT DOCUMENTS

| | | | |
|---|---|---|---|
| 3,864,976 | 2/1975 | Parker . | |
| 3,941,967 | 3/1976 | Sumi et al. . | |
| 3,941,968 | 3/1976 | MacMaster et al. . | |
| 3,985,991 | 10/1976 | Levinson . | |
| 4,028,118 | 6/1977 | Nakasuji et al. . | |
| 4,122,324 | 10/1978 | Falk . | |
| 4,144,435 | 3/1979 | Clark et al. . | |
| 4,156,365 | 5/1979 | Heinmets et al. . | |
| 4,190,757 | 2/1980 | Turpin et al. . | |
| 4,204,105 | 5/1980 | Leveckis et al. . | |
| 4,228,761 | 10/1980 | Glover et al. . | |
| 4,233,325 | 11/1980 | Slangan et al. . | |
| 4,258,086 | 3/1981 | Beall . | |
| 4,268,738 | 5/1981 | Flautt, Jr. et al. . | |
| 4,345,133 | 8/1982 | Cherney et al. . | |
| 4,351,997 | 9/1982 | Mattisson et al. . | |
| 4,416,907 | * 11/1983 | Watkins | 219/734 |

(List continued on next page.)

*Primary Examiner*—Philip H. Leung
(74) *Attorney, Agent, or Firm*—Bernard L. Kleinke; Foley & Lardner

(57) ABSTRACT

A shielding method for achieving highly uniform temperatures in liquids during microwave heating by substantially enhancing vertical mixing currents in said liquids, making determinations of final temperature reached in said liquids either by touch or the use of a temperature indicator efficacious, comprising: a electrically conductive shield having very low impedance at microwave frequencies; having, a generally cylindrical shape, and dimensions chosen to accommodate a variety of microwaveable containers. said shield: to be concentric with a microwaveable container, containing a liquid to be heated by microwave radiation; and, to be located so as the top edge of said shield is at or above a vertical level corresponding to the level of the liquid in said container; and, to be of sufficient height as to cover at least 10% of the height of the liquid in said container. 2. a shield according to claim 1, having; a height "h", covering between 10% and 90% of the height of the liquid contained in the container to be heated; and, a circumference/length "L" covering at least 90% of the circumference of the container to be heated.

9 Claims, 6 Drawing Sheets

U.S. PATENT DOCUMENTS

| | | | | |
|---|---|---|---|---|
| 4,425,161 | | 1/1984 | Shibahashi et al. . | |
| 4,439,656 | | 3/1984 | Peleg . | |
| 4,481,392 | | 11/1984 | Nibbe et al. . | |
| 4,501,946 | | 2/1985 | Nibbe et al. . | |
| 4,558,198 | | 12/1985 | Levendusky et al. . | |
| 4,620,941 | | 11/1986 | Yoshikawa et al. . | |
| 4,661,672 | | 4/1987 | Nakanaga . | |
| 4,689,458 | | 8/1987 | Levendusky et al. . | |
| 4,703,148 | | 10/1987 | Mikulski et al. . | |
| 4,703,149 | | 10/1987 | Sugisawa et al. . | |
| 4,777,053 | | 10/1988 | Tobelmann et al. . | |
| 4,851,631 | | 7/1989 | Wendt . | |
| 4,878,588 | | 11/1989 | Ephraim . | |
| 4,894,503 | | 1/1990 | Wendt . | |
| 4,919,983 | | 4/1990 | Fremin . | |
| 4,933,525 | * | 6/1990 | St. Phillips | 219/720 |
| 5,079,396 | * | 1/1992 | Katz et al. | 219/729 |
| 5,126,520 | | 6/1992 | Nottingham et al. . | |
| 5,230,914 | | 7/1993 | Akervik . | |
| 5,256,846 | | 10/1993 | Walters . | |
| 5,288,962 | | 2/1994 | Lorence et al. . | |
| 5,315,084 | * | 5/1994 | Jensen | 219/689 |
| 5,369,257 | * | 11/1994 | Gibbon | 219/720 |
| 5,370,883 | | 12/1994 | Saunier . | |
| 5,400,704 | | 3/1995 | Huston . | |
| 5,416,304 | * | 5/1995 | De La Cruz et al. | 219/729 |
| 5,464,968 | * | 11/1995 | Germain et al. | 219/720 |
| 5,498,857 | * | 3/1996 | Jacquault | 219/687 |

* cited by examiner

SHIELDING METHOD FOR MICROWAVE HEATING OF INFANT FORMULATE TO A SAFE AND UNIFORM TEMPERATURE

CROSS-REFERENCE TO RELATED APPLICATIONS

This application is a completed application based on Provisional Application No. 60/005,997 filed Oct. 27, 1995.

GOVERNMENT LICENSE RIGHTS

The U.S. Government has a paid-up license in this invention and the right in limited circumstances to require the patent over to license others on reasonable terms as provided for by the terms of Grant No. 2 R44 CE00063-02 awarded by the Centers for Disease Control and Center for Injury Prevention and Control.

BACKGROUND TO THE INVENTION

Microwave ovens are used in nearly 90% of U.S. households. The wide popularity of this appliance is well deserved since it delivers much of what is promised: faster and easier food preparation, cooler kitchens and easier clean-up.

An unexpected benefit of microwave cooking is that most types of burn injuries to children are much less frequent than from conventional ovens and stoves. There is, however, the disturbing finding of a class of injuries of increasing frequency with microwave oven use. These are burns to the oropharynx, palate and airway of infants fed from bottles that were heated in microwave ovens. Despite manufacturers' warning labels on baby bottle packages that discourage microwave heating and emphasize the potential risk, this problem persists.

There are several factors which contribute to this type of injury. Most significant are the uneven heating of the baby formula and the fact that the surface temperature is unrepresentative of the highest internal temperature. This situation would not result in burn injuries were it not for the care taker's failure to take the necessary steps to ensure safe delivery; namely, inverting the bottle several times to mix the contents to achieve uniform temperature, and testing the temperature of the liquid by dispensing a few drops on his/her skin.

Reflective electrically conducting materials opaque to microwave radiation have been used to affect cooking performance in microwave ovens in three ways. One application of these shields is to achieve differential heating when a plurality of foods is heated or cooked in a microwave oven. U.S. Pat. No. 3,865,301 describes a shielded container, opaque to microwave radiation except for radiation-transparent windows, used to heat a sandwich-type food comprised of a plurality of ingredients to different extents.

U.S. Pat. No. 4,851,631 to Wendt describes a food container with a cylindrical aluminum foil shield that protects the ice cream on a brownie from microwave radiation while the brownie is being heated.

U.S. Pat. No. 4,233,325 describes a two-component package containing a microwave reflective material which protects the ice cream in one compartment while a refrigerated syrup contained in a microwave transparent compartment is warmed.

Another application of metallic shields is to reduce the amount of microwave energy reaching a frozen food product by a controlled amount. Often the shield is combined with a glossy microwave absorber material so as to cook the food primarily by conduction heating. This is accomplished by shielding the major portion of the food product within the container from microwave radiation, while utilizing a layer of microwave absorber in contact with the food which heats the food as it absorbs radiation. This application of a shield with a microwave absorber is intended to enhance the organoleptic properties of the food.

U.S. Pat. No. 4,703,148 describes a package with sides made of an aluminum foil shield having windows whose size, number, and location are selected so as to achieve the desired level of crispness and browness.

U.S. Pat. No. 4,190,757 describes a metal foil laminated to Kraft paper bonded to the inside surface of a cardboard box for an individual size pizza pie. A predetermined number of openings are made in the shield so as to control the heating to result in a pizza with improved texture and appearance.

U.S. Pat. No. 3,941,967 describes a cooking apparatus containing a metallic shield capable of scorching a food. U.S. Pat. No. 4,351,997 to Mattisson et al. describes a food package containing side walls and rim coated with aluminum foil capable of cooking a composite frozen food product in a microwave oven to an even temperature with slight variations from 65° C. to 80° C.

U.S. Pat. No. 4,661,672 to Nakanaga describes an oblong container for use in microwave ovens comprising a shielding layer which covers the top of the contents and at least the upper half of the side walls on the short ends of the container which is capable of preventing hardening and drying of the corners of the contents, and allowing the contents to be uniformly and effectively heated.

Still another application of metallic shields is to achieve even heating.

U.S. Pat. No. 4,703,149 to Sugisawa et al. teaches that the top portion of food heated in a microwave oven is irradiated from both the top and sides causing the food to be heated unevenly. In a container according to this invention, a shielding layer is provided through the intermediary of an air layer at a position of the container where the shield covers at least the region where the upper surface of the contents make contact with the side surface of the container. The inventors found that interposing of an air layer between the microwave shielding layer and the container proper further increased heating efficiency and remarkably decreased induction heating in the shielding layer. It is alleged that with this design, sudden local boiling of the contents, such as soup, can be prevented.

U.S. Pat. No. 5,370,883 describes a package in a tray form for microwave heating of foods that provides an aluminum laminate for covering the side wall which allegedly gives excellent temperature distribution in microwave ovens. Despite the significant number of patents on the application of shields in the heating of food in microwave ovens, the use a foil reflector to microwave is clearly contraindicated in the technical literature. Shapiro and Bayne conclude their publication with oil labels covering a high percentage of the side wall area should not be used, since they prevent the penetration of microwave radiation through the jar and into the food, thereby inhibiting uniform heating."

For a considerable time manufacturers of microwave ovens have recommended that metallic shields not be introduced into microwave ovens because of potential damage to the magnetron and the potential for arcing that can damage the food package and char the food product. Arcing is a plasma arc discharge that produces a flash of light, a noise and sometimes ignition of the container.

The conductive shield can be a major source of arcing. Any discontinuity in the shield edge produces an intensification of the electric field emanating from that edge. At locations where the field strength is sufficiently large, an arc discharge will occur, and the heat produced in the arc may produce burning of adjacent portions of the food or the container. If the container is thermoplastic, it may deform or melt.

U.S. Pat. No. 3,865,301 to Pothier et al. describes design criteria for shielded containers to accomplish selective and controlled heating of foods in a microwave oven without arcing or charring. This patent teaches that it is desirable to reduce the number and sharpness of points in the conductive sheet. It also teaches that, in general, a conductive edge perpendicular to the shelf in a microwave oven is likely to produce arcing or charring. It further teaches that a single integral conductive sheet with no overlapped joints is more resistant to arcing then one piece with an overlapped joint.

U.S. Pat. No. 4,558,198 to Levendosky discloses a metal container and system for arc-free microwave cooking and minimal reflection of electromagnetic radiation. These benefits are achieved, according to the disclosure, by means of structural refinements in a metallic container, including the provision of smooth, wrinkle-free side and bottom walls and edges, a physical geometry incorporating generous radii in lieu of sharp corners in the container structure, and a coating of heat-resistant plastic material of a specified film thickness on both sides of the walls and edges of the container to diffuse microwave radiation.

U.S. Pat. No. 4,345,133 to Cherney et al. describes a partially-shielded microwave carton constructed such that adjacent portions of the panels forming the cover wall are provided with a low impedance electrical connection at microwave frequencies to inhibit arcing between such panels during heating and rounded to minimize the electric field intensity created at these corners-thus reducing the likelihood that arcing will occur between various portions of the cover, or between the cover and the surface on which the carton is supported.

U.S. Pat. No. 4,122,324 to Falk teaches that slight irregularities such as scratch mark or pinpoint in the shielding film can result in arcing and the attainment of temperatures in the region of the arc which far exceed the flash point of a combustible layer within the package. To avoid such problems, the patentee discloses that the sheet material from which the outer package is formed is coated or laminated on both surfaces with metal conductive layers so that no significant portion of the dielectric sheet is exposed to the oxygen in the air.

In order to practice the method if the instant invention it is desirable to measure the temperature within the container to be heated.

U.S. Pat. No. 4,156,365 to Heinmets et al. describes a thermochromic layer painted on the surface of a food vessel for indicating that the food content in the vessel has been heated above the minimum temperature of 60° C. for ensuring the cessation of and the production of toxins of certain harmful microorganisms and below a maximum safe temperature of 70° C. which can result in tissue damage to the lips, mouth and tongue if the food is ingested. No specific thermochromic composition for achieving this object is disclosed, nor does it indicate the method of heating, how the heating method might effect the thermochromic layer, or the usefulness of such an indicator in cases where the temperature is not uniform throughout the food.

U.S. Pat. No. 4,538,926 to Chretein describes a temperature indicating device for sensing the temperature of a bottle containing a liquid intended for human consumption. The temperature indicator of this invention is comprised of a cholesteric liquid crystal composition which undergoes a color change accompanying the broad temperature transition from the smectic to cholesteric phases printed on the bottle in the immediate vicinity of a heat insensitive color mark indicating the color corresponding to a temperature for optimal consumption of the liquid in the bottle.

U.S. Pat. No. 4,919,983 to Fremin describes an infant feeding bottle constructed of a thermoplastic containing a thermochromic microcapsular composition which undergoes a distinct change in color when the temperature is above the human range of comfort, about 36° C. to about 38° C. This Fremin '983 does not address the effect of microwave radiation on the thermochromic composition and on the additives for protection against UV radiation, nor does it address the problem of large temperature gradients in bottles containing liquids warmed in a microwave oven.

U.S. Pat. No. 4,878,588 to Ephraim describes a baby nursing bottle having a commercially available liquid crystal strip type thermometer disposed in its side wall. The size of this thermometer extends over the entire side of the baby bottle such that each discrete temperature sensor is located at a different height along the bottle. This invention is described to be reusable and stable after repeated microwave heating, cleaning in a dishwasher or sterilization with boiling water. It is the experience of the inventors of the present invention that commercial liquid crystal thermometers such as those described in Ephraim '588 are not stable under prolonged exposure to boiling water. The application of the type of thermometer disclosed in Ephraim '588 is of limited value if the bottle is heated in a microwave oven and the contents are not well mixed prior to the reading. A further limitation of liquid crystal strip thermometer made in accordance with the disclosures of Ephraim '588 is its failure to indicate whether the temperature at the surface to which it is applied is either above or below its range.

U.S. Pat. No. 3,864,976 to Parker describes a similar digital liquid crystal thermometer attached to a baby bottle with an elastomeric band having a thermometer structure of substantial flexibility so that it will conform to the container shape. Since the thermometer disclosed can be removed from the bottle during cleaning and sterilization, the commercial digital liquid crystal type thermometers are adequate for this application. Similar limitations, however, apply to its use discussed above. In conclusion, it is believed that the prior art on shielding has not addressed the means for enhancing mixing in liquids which are heated with microwave radiation such that substantially isothermal conditions are achieved throughout the liquid, therefore making useful a temperature indicator applied to the surface of the shielded bottle containing a liquid to be ingested by infants. Further, U.S. Pat. No. 4,851,631 which describes a metallic shield concentric with the container to be heated in a microwave oven teaches away from this invention by emphasizing that the geometry of a shield must be carefully selected to avoid resonance if the potential for arcing is to be eliminated. U.S. Pat. No. 4,703,149 also describes a cylindrically-concentric metallic shield, discloses that the microwave shield be separated from the container to be heated by an air gap.

U.S. Pat. No. 3,865,301 discloses that it is desirable to reduce the number and sharpness of points in the conductive sheet, that a conductive edge perpendicular to the shelf in a microwave oven is likely to produce arcing or charring and that a single integral conductive sheet with no overlapped joints is more resistant to arcing than one piece with an overlapped joint.

The prior art fails to address the problem of heating a baby bottle in a microwave oven so that its contents would reach a uniform temperature that would be faithfully represented by its surface temperature at any location, thereby securing the reliability of a decision regarding feeding safety based on external touch.

SUMMARY OF THE INVENTION

It has been found that it is possible to shield a baby bottle so that it can be heated in a microwave oven to a uniform and safe temperature. The inclusion of a microwave reflector to prevent the lateral penetration of microwave radiation on the upper portion of infant formula results in uniform temperatures throughout the liquid. The method of this invention is effective for microwave ovens from different manufacturers, of various capacities and power, both with and without turntables.

The shield can be made integral with the baby bottle or as a detachable separate entity. When integral with the bottle, the reflector consists of a thin metallic conducting film deposited on the surface of the bottle by plasma wire/powder, air gun spraying, pad printing, or as a adhesively coated metal foil/foil laminate. When applied as a separate entity, the reflector can be a band of metal, foil, or foil/film or film/foil/film laminates where the foil layer has sufficient electrical conductivity.

When the conductive shield is in intimate contact with the surface of the bottle, a temperature indicator with a message that alerts the care giver that the contents exceed the safe maximum temperature can be printed on its surface with an ink made from a thermochromic or a cholesteric liquid crystal composition. The transition temperature for this indicator can be offset to compensate for the difference between internal temperature of the contents and external surface temperatures. When the shield does not maintain good thermal contact with the bottle, the message printed with a temperature sensitive ink must be applied directly to the bottle surface.

DETAILED DESCRIPTION OF THE INVENTION

This invention relates to a method and device for uniformly heating the contents of a container, in particular a baby bottle, to a uniform temperature in a microwave oven.

Since the environment within a microwave oven is often described as "electrically hostile", an unshielded electrical sensor such as a thermocouple or thermistor will be heated by the microwave fields and its circuitry can be subject to electrical noise. The conductor leads of these electrical sensors cause two other problems: 1) they effect the distribution fields within the oven and thus alter the heating patterns, and 2) they act as a conductor for the microwave fields to escape the oven. Despite the limited accuracy of these sensors, they are useful as typical household temperature probes built into the oven. They are, however, too crude for applications where localized or surface measurements are important, or where rapid real time response is desired.

There are presently two laboratory methods which are widely used to measure temperatures during microwave heating of foods: one uses infrared imaging, and the other uses a fiberoptic probe with a minute speck of phosphor embedded in the tip.

The usefulness of infrared thermometry is limited to surface temperatures and even in this application is largely qualitative. The use of an infrared camera is further restricted because the glass door of the microwave oven is opaque to the infrared radiation. The large field of view of the camera would require a large hole for viewing and this would be unsatisfactory because microwave energy would escape through this hole.

The flouroptic method overcomes these difficulties but introduces other problems. In order to gather the many data points needed for temperature mapping, a multiplicity of sensors, all carefully positioned, are required. Also, for surface measurements, the output of this type of device is extremely sensitive to the intimacy of contact.

Because of the problems encountered with these temperature measurements, a new thermometer based on cholesteric liquid crystals was designed and developed specifically for application to the instant invention. This thermometer is derived from the disclosures in U.S. Pat. No. 3,974,317, incorporated herein by reference. A cholesteric liquid crystal system which can be used to construct thermometric elements capable of recording numerous increments in temperature from a single basic composition in a facile and economic manner.

Figure 1:
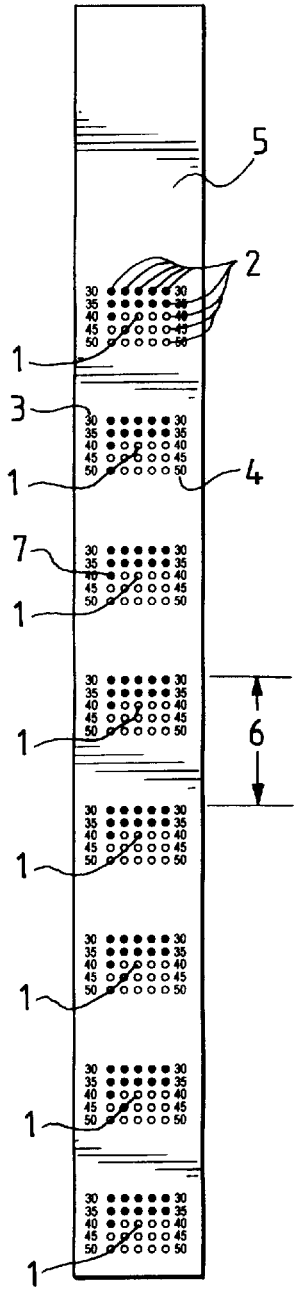
FIG. 1 shows a strip thermometer having eight thermometers thereon.

Referring now to FIG. 1, a continuous web of individual thermometers, 1, each consisting of 25 sensors, 2, spanning the range 30° C., 3, to 54° C., 4, in 1° C. increments, was made using the compositional formula taught in the '317 patent and a structure taught in copending U.S. patent application No. 08/344,346, incorporated herein by reference. Eight thermometers as described as supported on strip, 5, each being separated from one another by a space, 6, 1.4 cm. in legth. As displayed on FIG. 1 all eight thermometers show readings, 7, of 40.0° C. Thermometers made with the composition and structure specified in the '317 patent and patent application Ser. No. 08/344,346, exhibit hysteresis; i.e., they retain their maximum signal for about twenty seconds after they are removed from the hotter thermal environment and placed in a cooler one. This characteristic is important where measurements are made in opaque liquids such as infant formulas where it is necessary to remove the thermometers from the liquid in order to read them. These thermometers are also unlike those based on U.S. Pat. No. 4,878,588 which fail to indicate any information when the temperature is outside its range, because these liquid crystals display one color below their transition temperature and a second color above their transition temperature.

Figure 2:
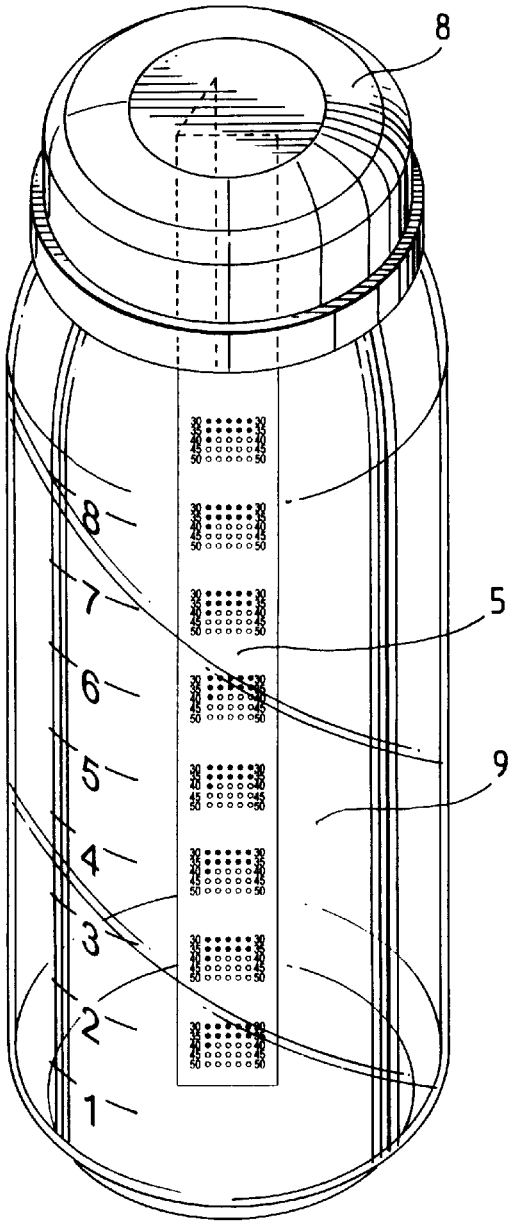
FIG. 2 depicts a strip thermometer suspended in a baby bottle

FIG. 2 shows a strip of thermometers (5) of this type suspended from the top of the bottle (8) into its contents so that they record temperature along the central axis of the bottle (9). This measurement can be made at any distance radially displaced from the center out to the inner wall of the bottle. These thermometer strings can also be affixed with an adhesive vertically or circumfrencially on the external surface of the bottle. The liquid crystals and plastic laminates used to make this thermometer are inert to microwave energy, meaning they do not absorb microwave energy. They are heated by thermal conduction from a surrounding microwave absorbing medium. Since the heat capacity of each thermometer is only 0.03 calories/° C. it is negligible relative to the heat capacity of the average quantity of fluid surrounding or plastic in contact with it, its presence has no measurable effect on the final temperature. A potentially more serious concern is whether the presence of such a string of thermometers either alters the convection- currents produced by microwave heating or provides a more conductive path for the distribution of heat. The extent of such influence, determined by comparing the temperature profiles of microwave heated solutions containing the thermometer string with those obtained from thermometer strings introduced into the bottles after they were removed from the oven, was demonstrated to be less than the resolving power of the measurement.

Figure 3:
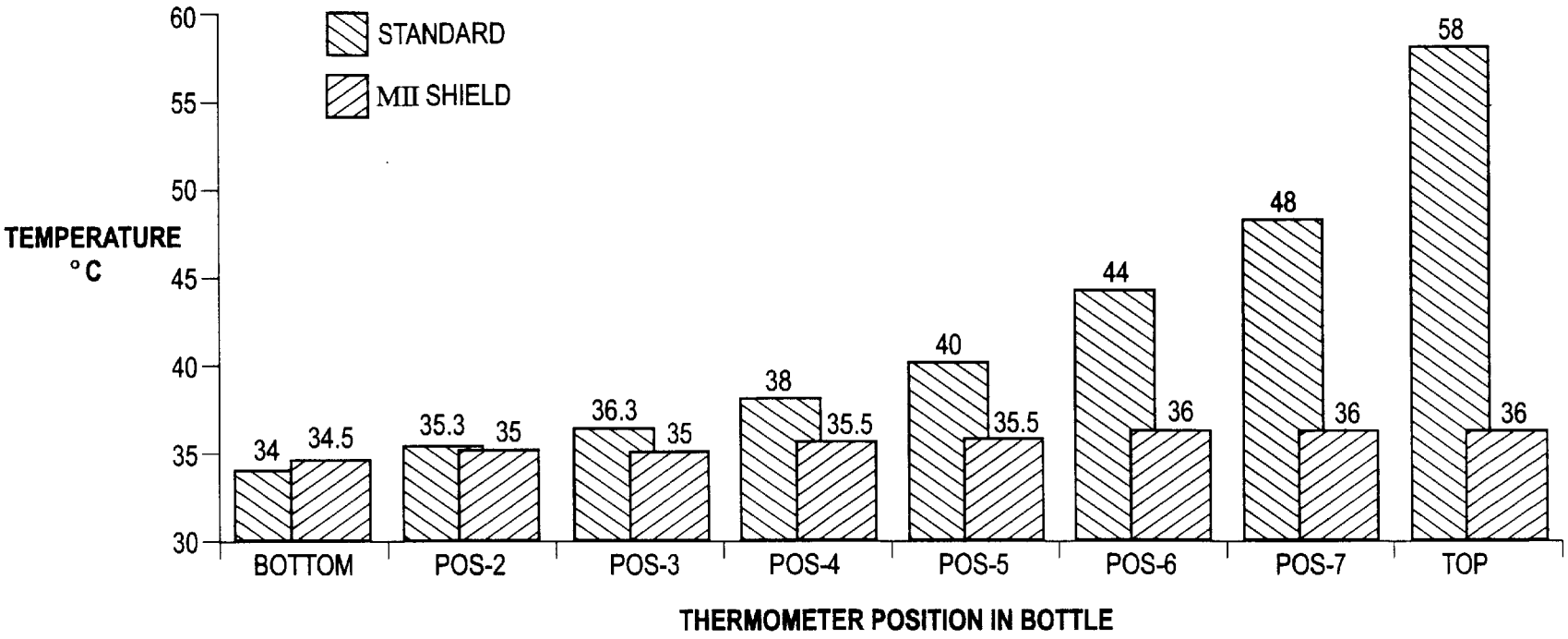
FIG. 3 shows a comparison of temperature profiles of standard and shielded baby bottles.
Figure 4C:
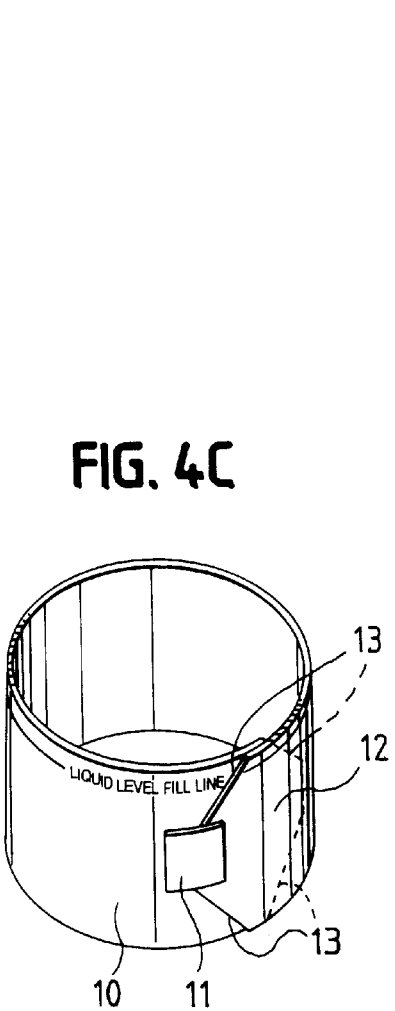
FIG. 4A, FIG. 4B, and FIG. 4C show the construction of a movable shield.
Figure 4B:
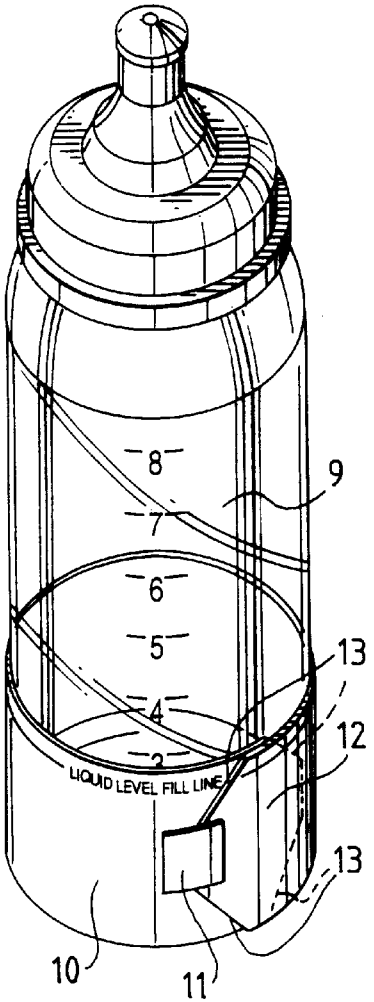
Figure 4A:
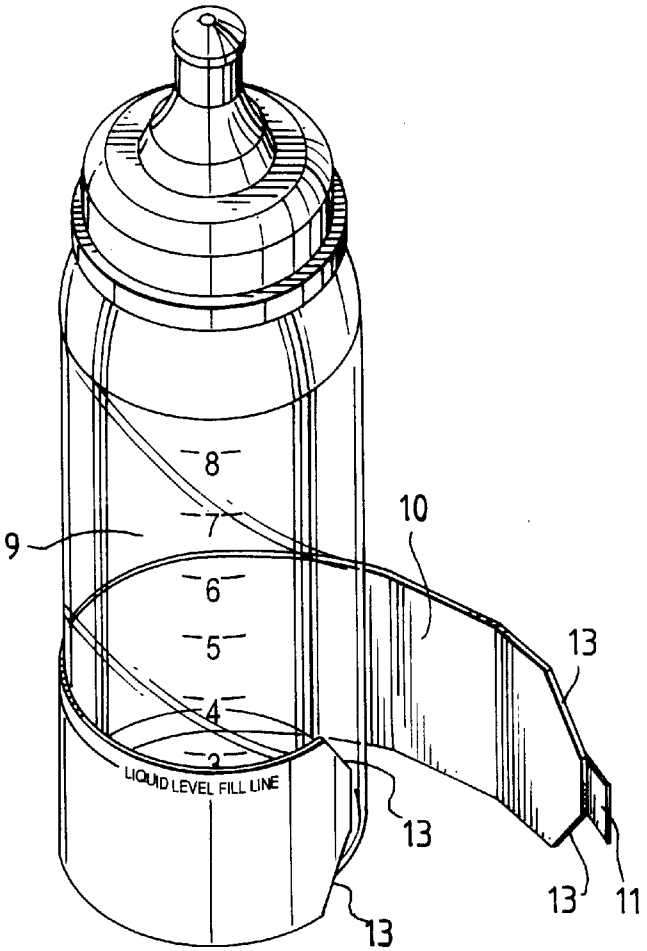
Figure 5:
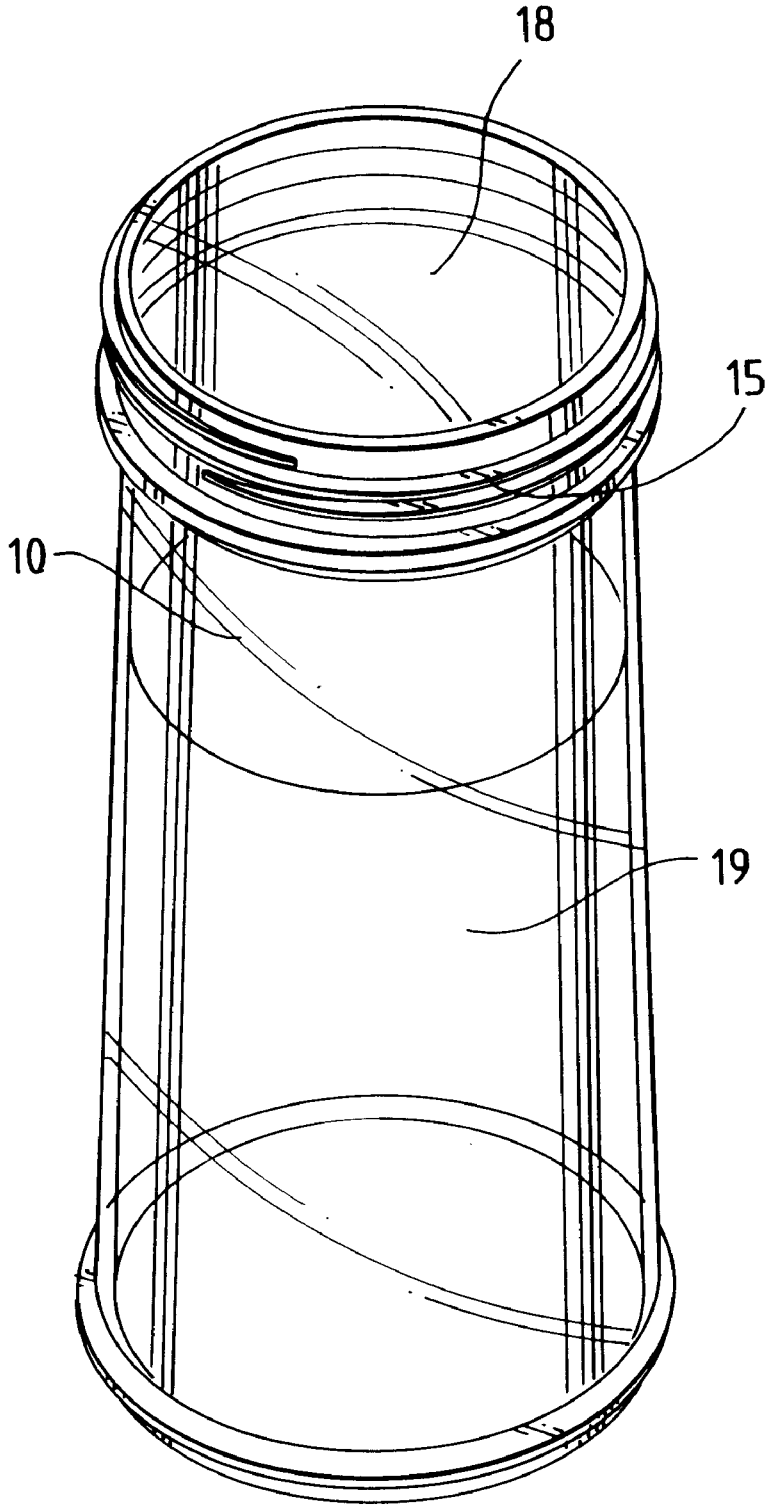
FIG. 5 shows a shielded support cylinder for a baby bottle liner.

FIG. 2 demonstrates the typical temperature profile found along the central axis of a bottle containing 237 ml (8 oz.) of infant formula with a uniform starting temperature of 4° C. heated for one (1) minute in a microwave oven at a power setting of 10 (900 watts). A critical observation is that although the average temperature, obtained by vigorously shaking the bottle after heating, was a safe 42° C., the temperature of the top ounce of fluid without shaking exceeded the 50° C. limit generally recognized as the highest temperature for safe feeding. Both the pattern of this temperature profile and the magnitude of the difference between the extremes were found to be relatively constant whether the bottle is placed at the center, corners, or the half-way points on the floor of the microwave oven. If the microwave oven contained a carousel, the temperatures as shown in FIG. 3, were only slightly less non-uniform. FIG. 3, shows the longitudinal surface temperature on a baby bottle heated under the conditions described above. The temperature gradient on the surface is quite similar to that of the Interior but about 1 to 2° C. cooler at all levels. Wrapping a string of 13 thermometers around the circumference of the bottle at any height demonstrated temperature uniformity of about plus or minus 1° C. This pattern of large temperature gradients along the z-axis and small temperature gradients in the x-y plane were characteristic of all microwave ovens, bottle types, bottle placement, fluid contents, power settings, heating times, and starting temperatures. FIGS. 4A, 4B and 4C show how the preferred embodiment of this invention, a cylindrical shield (10) is fit to a generally cylindrically shaped baby bottle (9). The shield (10) is fit to the bottle (9) by wrapping it around the bottle's circumference and joining with tape (11) the overlapping ends (12). Such a shield need only be fitted once, and may be removed and reapplied to the bottle by sliding the shield vertically on and off the bottles. The shield can be refit for use on many different bottles, is not handled by the infant and need not be subjected to any sterilization process. FIG. 5 shows an example of directional usage for the shield. The shield (10) is applied to a filled bottle (9) just prior to heating by placing the shield (10) on a flat surface (14) and sliding the filled bottle (9) down into the shield (10) until the bottle (10) rests on the flat surface (14). The shield (10) is then slid vertically up the bottle until the fill line (15) marked on the shield (10) matches the level of the liquid (16) in the bottle (10). The bottle's lid/nipple (17) is loosened to prevent any pressure build up during heating, the bottle is placed upright in the microwave (MW) oven and is cycled/heated to its final/desired temperature. Bottle placement in the microwave oven cavity, power and time settings will vary with type and condition of MW oven used. Final temperature reached may also be affected by, volume, type, and initial temperature of the liquid to be heated. After heating, the liquid in the bottle is tested for final/desired temperature reached, the lid/nipple (17) is retightened and the shield (10) is then slid off of the bottle (9) which is now ready for serving.

Such a removable shield can be constructed from a continuous section of a metal tube, foil, foil/film or metallized plastic tube. The metal must be a good electrical conductor (Resistivity less than or equal to 0.001 Ohm/sq.) and must be resistant to cuts, scratches, pin-holes and delamination. Because of its great availability in all of these forms and relatively low cost, aluminum is the preferred shielding material. Gold and silver are too costly for use in such a low cost consumer item; while long term oxidation problems with copper make it an unattractive candidate for this application. Zinc, nickel, tin and metal alloys from these elements are other possible shielding materials.

The preferred shield material is a polyester film/aluminum foil/polyester film laminate. The polyester layers protect the aluminum from defects which could produce arcing while adding strength and durability to the final structure/design. This material is readily available at a acceptable cost for this design. A tube made from aluminum or made from a thermoplastic with a highly conductive aluminum coating would also be a satisfactory choice for a removable collar type shield. Multi-color decorative figures and patterns could be applied to any of these embodiments to enhance the aesthetic acceptability of the shield.

The simplest effective shield design is one of cylindrical shape applied over the surface area which is to be shielded of a cylindrical baby bottle. Such cylindrical bottles are manufactured by, Luv n' Care® of Monroe, La., PN—1261 (Collectibles Series). Made of polycarbonate, they hold 237 ml (8 oz) of liquid and are 5.24 cm (2 1/16") in diameter with a height measured from base to the 8 oz mark of 11.43 cm (4½").

The shield can be made from a 0.0254 mm (0.001 in) thick aluminum foil, an aluminum foil/polyester laminate consisting of 0.0508 mm (0.002 in) clear polyester film laminated to 0.00889 (0.0035 in) aluminum foil, or a sandwich construction consisting of 0.0508 mm (0.002 in.) clear polyester film laminated to 0.00889 (0.0035 in) of aluminum foil laminated to 0.1016 mm (0.004 in) clear polyester. Both laminates are available from Industrial Laminating Corp. and designated product numbers 3035 and 2007B respectively. This latter type structure with the metal foil sandwiched between two layers of plastic is most resistant to the types of damage which cause arcing.

It was discovered that the microwaves could induce large currents which caused some localized unwanted self heating at the corners of square cut shields and that this effect could be minimized by mitering the corners (13) of the foil or foil/laminate as shown in FIGS. 4A, 4B, and 4C. An alternative approach is to round the corners using a generous radius or by using a conductive adhesive at the overlap area.

The rectangular shield with mitered corners was wrapped around the bottle so that the overlapping mitered ends could be taped to form the collar shape. The fit was loose enough as to permit movement by hand, but tight enough that the collar/shield could not slide on its own. Shields made of these three materials were constructed as follows:

EXAMPLE 1

A shield made from a rectangular section of 0.0254 mm (0.001 in) aluminum foil of dimensions 5.08 cm (2.0 in)×

18.2 cm (7.17 in) is wrapped around a cylindrical bottle such that the ends of the shield overlapped each other by 3.81 cm (1½"), taped such that the shield is retained on the bottle by frictional engagement and positioned such that its upper edge is located 9.5 mm (⅜") above the 8 oz mark.

EXAMPLE 2

A shield made from a rectangular section of 3035 laminate having dimensions 5.08 cm (2.0 in)×18.2 cm (7.17) with mitered ends as shown in FIG. 3. The corners were then cut at 45 degree angles 1.27 cm (½") in from the edges. The rectangular-cut laminate was wrapped around the circumference of the bottle so that the top edge of the shield was approx. 3.175 mm (⅛") above the 237 ml (8 oz) line on the bottle. The overlapping ends of the shield were taped together and retained on a cylindrical bottle by frictional engagement such that its upper edge which was located 9.5 mm (⅜") above the 8 oz mark.

EXAMPLE 3

A shield made from a rectangular section of 2007B laminate having dimensions 5.08 cm (2.0 in)×18.2 cm (7.17) with mitered ends as shown in FIG. 4. The corners were then cut at 45 degree angles 1.27 cm (½") in from the edges. The rectangular-cut laminate was wrapped around the circumference of the bottle so that the top edge of the shield was approx. 3.175 mm (⅛") above the 237 ml (8 oz) line on the bottle. The overlapping ends of the shield were taped together and retained on a cylindrical bottle by frictional engagement such that its upper edge which was located 9.5 mm (⅜") above the 8 oz mark.

An alternative embodiment of this invention is a shield which is permanently affixed to the surface of the baby bottle. This offers the advantage of a single integral microwaveable baby bottle and eliminates the potential for forgetting to use the shield as presented with the removable type. On the other hand such a permanent type shield would represent greater costs, must be more robust and safe so that it can be handled by the infant and subjected to frequent cleaning and sterilization by boiling water. A fixed shield bottle design requires that a continuous, uniform coating of a highly conductive metal be applied to the bottle. Additionally, overcoats of protective polymers and decorative paint may be optionally employed. A fixed shield can be made from any of the foil or foil film laminates used to make a removable shield.

EXAMPLE 4

A shield made from 0.0254 mm (0.001 in) aluminum foil of height 5.08 cm (2.0 in) permanently fixed to the surface of the bottle with a pressure sensitive rubber based adhesive so that its upper edge was located approximately 9.5 cm (⅜") above the 8 oz line marked on the bottle. The ends of the shield overlapped each other approximately 3.81 cm(1½").

A fixed metallic coating also can be applied by spraying or pad printing using a conductive paint or ink. Of the commercially available conductive paints containing silver, nickel, silver/nickel alloys, and carbon compositions, only highly conductive formulations of silver inks yielded acceptable results.

EXAMPLE 5

The shield material was a silver-bearing ink manufactured by, Metech, Inc. of Elverson, Pa. and designated PN—6103A. Polycarbonate baby bottles were masked with masking tape and the exposed surface was cleaned with isopropanol to remove any oils from hand contact. The lower edge of the upper mask, was approximately 3.175 mm (⅛") above the 237 ml (8 oz) line on the bottle. The top edge of the lower mask was approximately 3.81 cm (1½") below the 237 ml (8 oz) line on the bottle. The bottles were mounted in the center of a rotating table and turned at approximately 60 rpm. They were then spray-coated between the masks using a Badger Model 150 artist spray gun and the ink which was thinned to a water like consistency with Metech, Inc., PN—3992 thinner; For production a HVLP spray system could be used to apply the coatings. A top coat of some tough polymer would be added to help prevent damage to the conductive coating.

Metallic coatings can be applied by plasma wire/powder spraying using any metal or metal alloy of high electrical conductivity which can be drawn into a wire form or made available in a powder form. Both aluminum and zinc coatings produced by plasma wire spraying are useful because they exhibit electrical and physical properties which are deemed satisfactory for this invention, and because the technology for this application method is mature and of relatively low cost.

EXAMPLE 6

Plasma Powders, Inc. of Marlboro, N.J. coated polycarbonate baby bottles with aluminum by plasma wire spray to a thickness of approximately 0.0127 mmc (0.0005") of aluminum. The upper edge of the coating, was approximately 3.175 mmc (⅛") above the 237 mlc (8 oz) line on the bottle. The lower edge of the coating was approximately 3.81 cmc (1½") below the 237 mlc (8 oz) line on the bottle.

EXAMPLE 7

Plasma Powders, Inc. of Marlboro, N.J. coated polycarbonate baby bottles with zinc by plasma wire spray to a thickness of approximately 0.0127 mmc (0.0005") of zinc. The upper edge of the coating, was approximately 3.175 mmc (⅛") above the 237 mlc (8 oz) line on the bottle. The lower edge of the coating was approx. 3.81 cmc (1½") below the 237 mlc (8 oz) line on the bottle.

Shielded bottles according to the above seven examples were filled to a level of 237 ml (8 oz) with 4–5° C. infant formula and tested under conditions of one minute cycles time and power level setting of 10 in a GE Model No. JE1456L, 900 watt, no turntable microwave oven. FIG. 5 shows the effectiveness of this type of shield along the central axis of the bottle. Also shown for comparison are corresponding temperatures without the shield. Table 1 lists the results of experiments on shields made according to the seven examples above where the shield number, 1,2, . . . , 7 correspond to examples numbers 1,2, . . . , 7. The temperatures listed are those measured along the central axis of the bottle from top to bottom. Each entry is the average of five trials. $T_{mean}$ is the average of the eight position average temperature measurements in a column, ΔT is the difference between the highest and lowest values and T(In)−T(Out) is the average difference between the average internal and average surface temperature. The remarkable efficacy of the shield is demonstrated by comparing the ΔT values of the unshielded bottle (ΔT=24° C.) and the shielded bowtles (ΔT=1° C.).

TABLE 1

| | Shield Type | | | | | | | |
|---|---|---|---|---|---|---|---|---|
| Position | None | No. 1 | No. 2 | No. 3 | No. 4 | no. 5 | No. 6 | No. 7 |
| 8 top | 60 | 36.6 | 36.0 | 35.8 | 36.6 | 37 | 37 | 36 |
| 7 | 50 | 36.5 | 36.0 | 35.8 | 36.6 | 37 | 37 | 36 |
| 6 | 48 | 36.5 | 35.8 | 35.8 | 36.6 | 37 | 37 | 36 |
| 5 | 42 | 36.0 | 35.8 | 35.6 | 36 | 36.5 | 37 | 36 |
| 4 | 40 | 35.8 | 35.8 | 35.4 | 35.8 | 36 | 37 | 36 |
| 3 | 38.4 | 35.8 | 35.6 | 35.4 | 35.8 | 36 | 36 | 36 |
| 2 | 37.4 | 35.7 | 35.2 | 35.0 | 35.8 | 36 | 36 | 35 |
| 1 | 36 | 35.5 | 35.2 | 34.8 | 35.5 | 36 | 36 | 35 |
| Tmean | 43.7 | 36.05 | 35.68 | 35.45 | 36.09 | 36.44 | 36.63 | 35.75 |
| ΔT | 24 | 1.1 | 0.8 | 1.0 | 1.1 | 1.0 | 1.0 | 1.0 |
| Tin - Tout | | 1.5 | 1.0 | 1.1 | 1.5 | 1.1 | 1.3 | 0.8 |

Testing of bottles with these shields were also performed in Tappan Model No. SMS107T1B1, 1,000 watt and Sharp Model No. R-5A54, 900 watt microwave ovens. Both of these ovens are equipped with a turntable. Tests were made using refrigerated (4–5° C.) water for variable energy input. For these tests the bottle was locate on the outside edge of the turntable. The collar/shield was always placed so that its top edge was 3.2 mm (⅛ in. above the liquid level under test, In all of the ovens it was found that although the average temperature increases linearly with increasing exposure time as expected, ΔT values remained relatively constant. For example, in the GE oven, a cycle time of 50 seconds yielded a $T_{mean}$ of 30.6° C. and a ΔT of 2.0° C.; and a cycle time of 90 seconds yielded a $T_{mean}$ of 49.3° C. with a ΔT—again of only 2.0° C.

For the Tappan oven a cycle time of 50 sec. yielded a $T_{mean}$ of 32.0° C. with a ΔT—of 0.0° C., and, a cycle time of 80 seconds yielded a $T_{mean}$ of 49.5° C. with a ΔT of 1.0° C.

For the Sharp oven, a cycle time of 60 seconds yielded a $T_{mean}$ of 31.1° C. with a ΔT of 1.0° C.; and a cycle time of 110 seconds yielded a $T_{mean}$ of 49.6° C. with a ΔT—again of only 1.0° C.

The effective range of liquid levels for these fixed shields was limited. Uniformity of temperature was achieved with levels ranging from 178 ml (6 oz.) to 237 ml (8 oz.). The ΔT (largest internal temperature difference in the bottle) did not exceed 2.0° C. for all tests in all microwave ovens within this range of liquid levels.

By employing a movable shield made in accordance with examples 1, 2 or 3 the useful range of the shield can be extended down to 2 ounces of fluid. For quantities below 6 oz. it is necessary that the shield be moved such that its upper edge is approximately ⅛" above the level of liquid in the bottle on the outside surface of a cold bottle. For testing, a collar-type shield made from foil laminate 3035 with flat stock measurement height equal to 3.81 cm (1.5 in) and length equal to 20.3 cm (8.0 in) was employed. This length is needed encompass the 16.95 cm (6.67 in) circumference of the bottle, leaving a sufficient length to accommodate end overlap and end terminations.

Tables 2,3 and 4 demonstrate the effectiveness of these collar-type shields when adjusted such that the upper edge is about ⅛" above the height of the liquid level in the bottle for liquid levels covering the range 1–9 ounces. This adjustable shield was effective for liquid levels from 267 ml (9 oz) down to 59.3 ml (2 oz) maintaining a ΔT no greater than ±1.0° C. in all tests. In this series with decreasing liquid mass in the bottle, the power settings must be reduced in order to maintain a safe $T_{mean}$.

TABLE 2

| | GE Model No.-JE1456L, 900 watt, no turntable | | | | | | | | |
|---|---|---|---|---|---|---|---|---|---|
| | FLUID LEVEL (Ounces of Water, 4–5° C.) | | | | | | | | |
| Position | 9 | 8 | 7 | 6 | 5 | 4 | 3 | 2 | 1 |
| 9 | 34.0 | X | | | | | | | |
| 8 | 34.0 | 36.0 | X | | | | | | |
| 7 | 34.0 | 36.0 | 38.0 | X | | | | | |
| 6 | 34.0 | 36.0 | 38.0 | 33.0 | X | | | | |
| 5 | 34.0 | 36.0 | 38.0 | 33.0 | 37.0 | X | | | |
| 4 | 34.0 | 36.0 | 37.0 | 33.0 | 37.0 | 35.0 | X | | |
| 3 | 33.5 | 35.0 | 37.0 | 32.0 | 36.0 | 35.0 | 37.0 | X | |
| 2 | 33.0 | 35.0 | 37.0 | 32.0 | 36.0 | 35.0 | 36.0 | 32.0 | X |
| 1 | 33.0 | 35.0 | 37.0 | 32.0 | 36.0 | 35.0 | 36.0 | 32.0 | ≧54 |
| Tmean | 33.75 | 35.63 | 37.43 | 32.50 | 36.40 | 35.00 | 36.33 | 36.50 | ≧54 |
| ΔT | 1.0 | 1.0 | 1.0 | 1.0 | 1.0 | 0 | 1.0 | 1.0 | X |
| Power | 10 | 10 | 10 | 8 | 8 | 7 | 7 | 7 | 6 |

TABLE 3

| | Tappan Model No.-SMS107T1B1, 1,000 Watt, Turntable | | | | | | | | |
|---|---|---|---|---|---|---|---|---|---|
| | FLUID LEVEL (Ounces of Water, 4–5° C.) | | | | | | | | |
| Position | 9 | 8 | 7 | 6 | 5 | 4 | 3 | 2 | 1 |
| 9 | 33.0 | X | | | | | | | |
| 8 | 33.0 | 35.5 | X | | | | | | |
| 7 | 33.0 | 35.5 | 37.0 | X | | | | | |
| 6 | 33.0 | 35.0 | 37.0 | 33.0 | X | | | | |
| 5 | 33.0 | 35.0 | 37.0 | 33.0 | 37.0 | X | | | |
| 4 | 33.0 | 35.0 | 37.0 | 33.0 | 37.0 | 35.0 | X | | |
| 3 | 33.0 | 35.0 | 37.0 | 33.0 | 37.0 | 35.0 | 38.0 | X | |
| 2 | 32.0 | 35.0 | 37.0 | 32.5 | 36.0 | 34.0 | 38.0 | 34.0 | X |
| 1 | 32.0 | 34.0 | 36.0 | 32.0 | 35.0 | 33.0 | 37.0 | 34.0 | ≧54 |
| T | 32.78 | 35.0 | 36.86 | 32.75 | 36.40 | 34.25 | 37.67 | 34.0 | ≧54 |
| ΔT | 1.0 | 1.5 | 1.0 | 1.0 | 2.0 | 2.0 | 1.0 | 0 | X |
| Power | 8 | 8 | 8 | 7 | 7 | 6 | 6 | 5 | 5 |

TABLE 4

| | Sharp Model No.-R-5A54, 900 Watt, Turntable | | | | | | | | |
|---|---|---|---|---|---|---|---|---|---|
| | FLUID LEVEL (OUNCES of Water, 4–5° C.) | | | | | | | | |
| Position | 9 | 8 | 7 | 6 | 5 | 4 | 3 | 2 | 1 |
| TOP | | | | | | | | | |
| 9 | 31.0 | X | | | | | | | |
| 8 | 31.0 | 32.0 | X | | | | | | |
| 7 | 31.0 | 32.0 | 35.5 | X | | | | | |
| 6 | 31.0 | 32.0 | 35.5 | 34.0 | X | | | | |
| 5 | 31.0 | 31.0 | 35.5 | 34.0 | 36.0 | X | | | |
| 4 | 31.0 | 31.0 | 35.0 | 34.0 | 36.0 | 35.0 | X | | |
| 3 | 31.0 | 31.0 | 35.0 | 33.5 | 36.0 | 35.0 | 35.0 | X | |
| 2 | 30.0 | 31.0 | 35.0 | 33.0 | 35.0 | 34.0 | 35.0 | 36.0 | X |
| 1 | 30.0 | 31.0 | 35.0 | 33.0 | 35.0 | 34.0 | 34.0 | 34.0 | ≧54 |
| BOT-TOM | | | | | | | | | |
| Tmean | 30.78 | 31.38 | 35.21 | 33.50 | 35.60 | 34.50 | 34.67 | 35.0 | ≧54 |
| ΔT | 1.0 | 1.0 | 0.5 | 1.9 | 1.0 | 1.0 | 1.0 | 2.0 | X |
| Power | 10 | 10 | 10 | 9 | 9 | 8 | 6 | 6 | 6 |

As shown in Tables 2, 3 and 4 as the volume of fluid heated is reduced the movable shield must be lowered to the new level of liquid in the bottle and the power setting must be changed.

The factors which determine the preferred height of the shield include. (1) the final average temperature target, (2) the effective range of liquid levels, (3) cost and (4) the amount of energy reflected back to magnetron.

For a one minute cycle on a filled bottle the final average temperature will depend predominantly on the wattage of the microwave oven and be safe for ingestion by an infant. If some infants experience burns to the tissue in the mouth and throat at 50° C., then a safe maximum temperature for the liquid contents can be set at 45° C. Since the refrigerated temperature could be 5° C. greater than the optimal 4° C. used to obtain the data in Table 5, the final temperature reached by the 8 ounces could be as much as 5° C. higher than the entries in Table 5. In this case, a shield height of 2.5" would be preferred. if a shield of this height was used in a microwave oven of 800 watts power, the lowest final temperature after a one minute exposure, assuming a starting temptnature of 4° C., would still be a safe and comfortable 33° C. For microwave ovens of maximum power lower than 800 watts, the shield height could be reduced so that a final uniform temperature of say 37° C. is achieved when refrigerated infant formula is heated for one minute at maximum power setting.

The data presented in Table 5 are the temperature profiles of bottles containing 8 ounces of refrigerated infant formula with aluminum shields made according to Example 2 but with heights varying in half inch increments between ½" and 4.0". These nine bottles were all subjected to heating in the Tappan microwave oven at full power (10) for one minute. For each ½" increase in shield height approximately 9% more of the total surface is shielded, an additional ounce of liquid is protected without moving the shield, the mean temperature for a one minute exposure falls about 2° C. and the amount of energy lost to the oven increases about 5%. A certain fraction of this energy which is not absorbed by the wall and table in the oven is reflected back to magnetron but because of the short heating cycle probably causes little loss of magnetron life. Table 5 also demonstrates that the height of the shield is not a critical factor in determining its efficacy for this application as sizes from ½" to 4.0" were all satisfactory.

| | Height | | | | | | | | |
|---|---|---|---|---|---|---|---|---|---|
| Position | 0 | ½" | 1.0" | 1.5" | 2.0" | 2.5" | 3.0" | 3.5" | 4.0" |
| 8 top | >54 | 47 | 44.5 | 43 | 42 | 40 | 38 | 35 | 33 |
| 7 | >54 | 47 | 44.5 | 43 | 42 | 40 | 38 | 35 | 31 |
| 6 | | 47 | 44 | 43 | 41 | 40 | 37 | 35 | 31 |
| 5 | | 47 | 44 | 43 | 42 | 40 | 37 | 35 | 31 |
| 4 | | 46 | 44 | 43 | 41 | 40 | 37 | 35 | 31 |
| 3 | | 46 | 44 | 43 | 41 | 39 | 37 | 34 | 30 |
| 2 | | 45 | 44 | 43 | 41 | 39 | 37 | 34 | 30 |
| 1 | | 45 | 43 | 42 | 41 | 39 | 37 | 34 | 30 |
| Tmean | 48.2 | 46.3 | 44.0 | 42.9 | 41.3 | 39.6 | 37.3 | 34.6 | 30.8 |
| ΔT | | 2.0 | 1.5 | 1.0 | 1.5 | 1.0 | 1.0 | 1.0 | 3.0 |
| % Shielded | 0 | 9 | 18 | 27 | 36 | 45 | 54 | 63 | 72 |

Figure 6C:
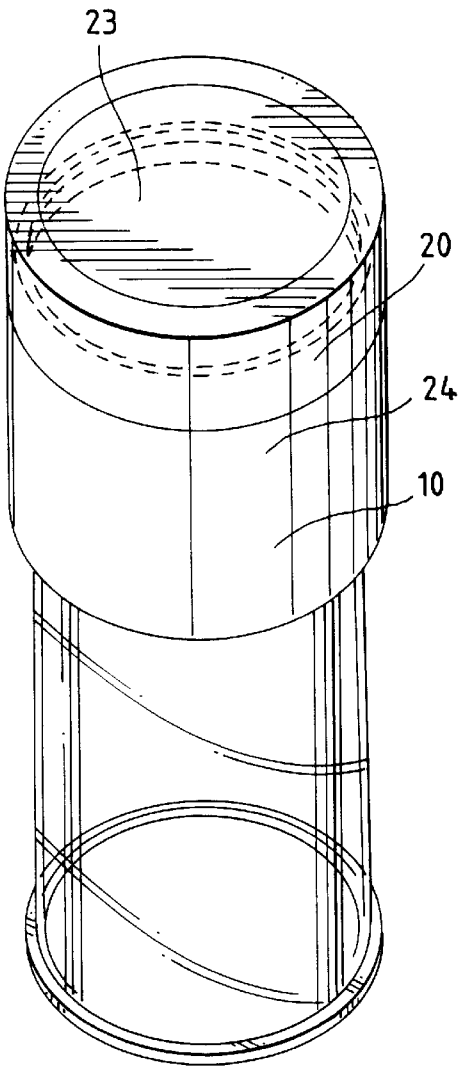
FIG. 6A, FIG. 6B, and FIG. 6C show an external cap for a support cylinder.
Figure 6B:
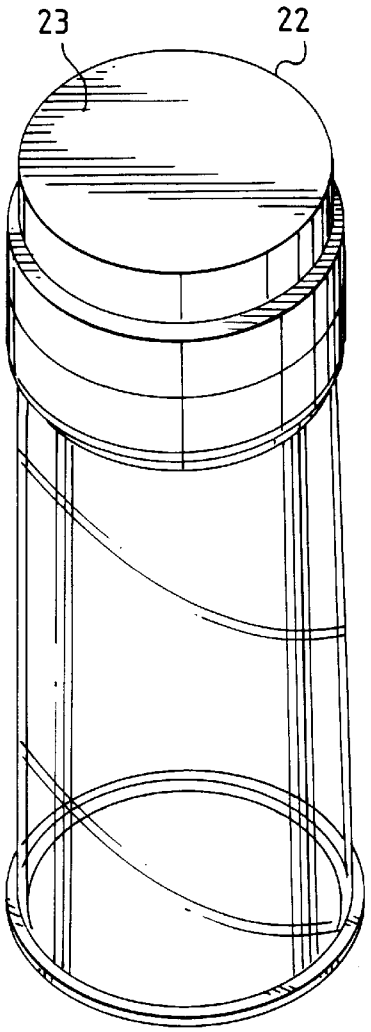
Figure 6A:
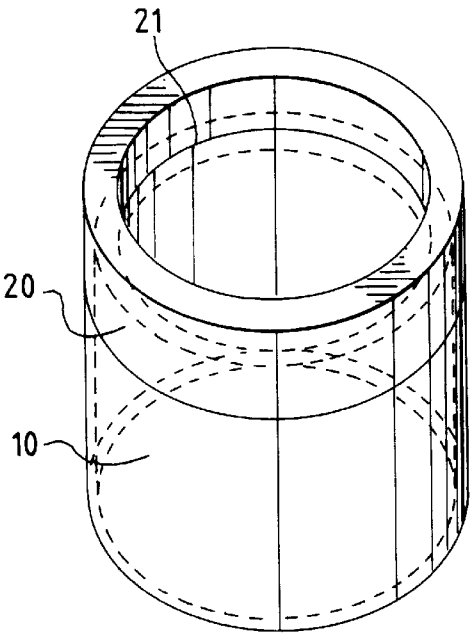

A further embodiment of this invention is to disposable baby bottle liners. These single use polyethylene bags are supported by a cylindrical plastic tube to which can be screwed on the nipple's retaining ring or cap. Since the threaded region of the plastic tube support prevents a shield from reaching the upper ½", the metal shield should be coated on its inner surface so that it can protect the upper liquid from excessive exposure during warming in a microwave oven. This design is shown in FIGS. 6A, 6B and 6C. The shield (10) located on the inner surface (18) of the support cylinder (19), the upper edge of said shield (10) being above the 8 oz. fill line (15).

Figure 7:
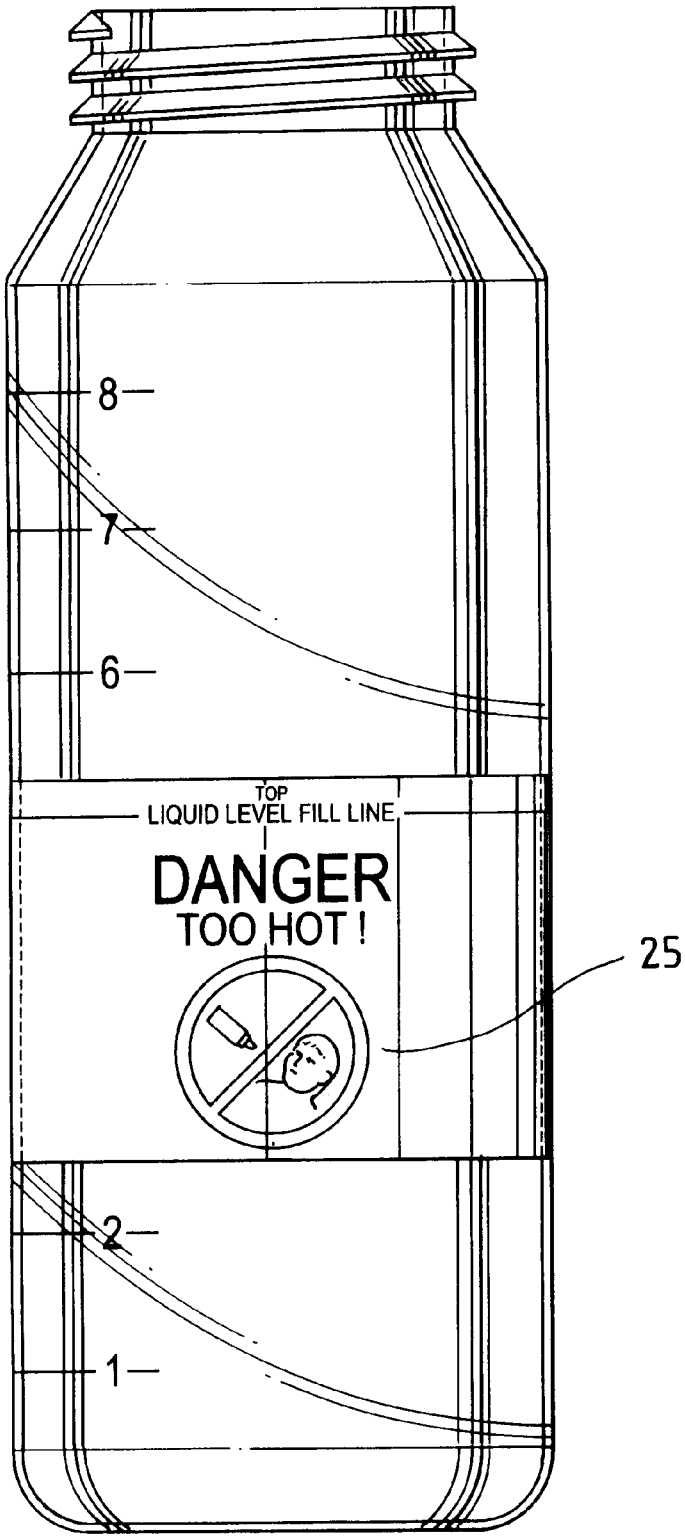
FIG. 7 shows a thermochromic warning message and icon on a baby bottle.

FIG. 7 shows an alternative approach, the use of a shield designed to augment the nipple's protective cap. The shield (10) being affixed to a external shielding Cap (20), said shielding cap having a inner lip (21) which when in place (24), rests on the recessed edge (22) of the nipple's protective cap (23) allowing the shield (10) to externally cover the desired vertical range of liquid levels.

The preferred type of upper limit temperature indicator for this application is one based on a modification of the thermochromic compositions described in U.S. Pat. No. 4,028,118. An excellent choice of compounds for indicating a temperature about 45° C. consists of crystal violet lactone as the electron donating chromatic compound, bis phenol A as the phenolic group compound, and hexadecano) as the aliphotic monovalent alcohol (m.p.=45° C.). The addition of the fourth component taught in, '118, the higher aliphatic monovalent ester, was found not to be needed. At a ratio of 5:15:80 a solution of these compounds undergoes a distinct color change between 44° C. and 45° C. Printing inks can be formulated from such a thermochromic material or from microencapsulated thermochromic material according to the teachings of '118. The choice of this composition for this application is based on its transition from blue to colorless over a relatively narrow temperature range around 45° C., stability and ultraviolet insensitivity, rapid reversibility and its ability to be microencapsulated and formulated into a printing ink or paint. Other colors can be selected by replacing the crystal violet lactone with rhodamine B lactam, 3-diethylamino-6-methyl-7-chlorofluoran, 3-diethylamino-5-methyl-7-dibenzylaminoflouran, 3-diethylamino-7,8-benzoflouran, 3-chloro-6-cyclohexylaminoflouran and DI-B thospiropyran.

The preferred placement of the temperature indicator in the removable collar type shield that makes intimate contact with the bottle is directly on the shield. As shown above, temperatures measured with the liquid crystal type thermometers on the bottle surface are uniform and on average only 1 lower than in the uniform liquid. Positioning the temperature indicator on the removable shield obviates the requirement to make it impervious to the harsh conditions of cleaning and sterilization. On the other hand, if the cross sectional geometry of the bottle is a polygon and intimate contact with the shield is not insured, the temperature indicator may be printed directly on the bottle. In this instance because the bottle is reusable it will prove necessary to prevent the dissolution or destruction of the microcapsules during the repeated washing and sterilization processes by the use of overcoats of water impervious polymers. Alternatively, the thermochromic ink can be reversed printed on a Mylar (registered trademark of DuPont's polyethylene terephthalate film) label which is subsequently coated with a pressure sensitive adhesive. When applied to the bottle the 8thermochromic ink is trapped between the Mylar and adhesive layers offering protection against the washing and sterilization processes.

In the case of the thin film plastic disposable liners, the thermochromic ink message would be printed on the outside surface of the liner or a label similar to that described above could be applied to the liner during its manufacture or by the end user prior to warming in a microwave oven. The adhesive on such a label could be of the type that allows repeated removal and re-application so that a single label could be used to check several microwave heated bottle liners.

An example of the type of printed warning is shown in FIG. 8. A printed message or icon (25) denoting burn danger is masked with a thermochromic ink (not shown) having a clearing temperature set approximately below the scalding temperature of 50° C.

According to the description hereinabove the present invention provides a novel method for obtaining a uniform and safe temperature when warming the contents of a baby bottle in a microwave oven. Of course various alternative and modified embodiments of the invention other than described hereinabove have been contemplated by the inventors, and such certainly would occur to others skilled in the art once appraised of the invention herein. Accordingly, it is our intent that the invention be construed broadly and limited only by the scope of the claims appended hereto.

What is claimed is:

1. In a shielded container device including a container having an elongated section operable to receive a quantity of a heatable liquid, a shield comprising:

a member having a circular cross-section or the cross-section of a section of a circle with a radius sufficient to concentrically receive the cylindrical section of said container and a height less than the length of the cylindrical section of said container so that a lower portion of the cylindrical section is unshielded, said shield being fabricated at least in part from a material having a high microwave reflectivity, thereby permitting, upon the application of microwaves to liquid disposed in the container, wherein said shield is moveable along the vertical axis of the container so as to accommodate different liquid volumes within said container, a temperature gradient to arise between the liquid disposed behind the shielded area and liquid below the shielded area, thereby facilitating the mixing and uniformity of temperature of liquid disposed within the container; and a thermochromic ink-based temperature-sensitive display disposed on said shield and responsive to the temperature of liquid disposed in the container.

2. The shield according to claim 1 having a cylindrical shape.

3. The shield according to claim 1 further comprising a base section and a non-shielding section.

4. The shield according to claim 1 wherein the material having a high microwave reflectivity covers between 10% and 90% of the cylindrical section of said container, and the material having a high microwave reflectivity covers at least 90% of the circumference of the cylindrical section of said container.

5. The moveable shield according to claim 1, wherein the shield is placed directly on the outside surface of the container such that the shield is substantially held to the container by friction, the friction being large enough to maintain a selected position along the vertical axis of the container during the heating, the friction being low enough to permit easy attachment to, adjustment on and removal from the container while compensating for thermal expansion of the container, the shield sufficiently thermally contacts the container to permit the use of a temperature indicator disposed in said shield.

6. The shield according to claim 1, wherein shield radius is large enough so that the material having a high microwave reflectivity does not significantly touch the container.

7. In a shielded container device including for a microwaveable container having an elongated substantially cylindrical section operable to receive a quantity of a heatable liquid, said shield comprising:

said shield being flexible and fabricated at least in part from a material having a high microwave reflectivity and having a generally rectangular configuration with a length sufficient to encircle at least 90% of the circumference of the cylindrical section of said container and a width less than the length of the cylindrical section of said container so that upon being encircled by said shield a lower portion of the cylindrical section is unshielded, thereby permitting, upon the application of microwaves to liquid disposed in the container, a temperature gradient to arise between the liquid disposed behind the shielded area and liquid below the shielded area, thereby facilitating the mixing and uniformity of temperature of liquid disposed within the container;

a thermochromic ink-based temperature-sensitive display disposed on said shield so as to be visible when said shield encircles a container, said display being responsive to the temperature of said liquid; and means for securing said shield to the container.

8. The fixed shield according to claim 7, conformed to contact the outside surface of the container and secure the fixed shield to said container.

9. The fixed shield according to claim 7, comprising a holder into which the container may be placed so as to heat the liquid by microwave radiation.

* * * * *

UNITED STATES PATENT AND TRADEMARK OFFICE

CERTIFICATE OF CORRECTION

PATENT NO. : 6,222,168 B1
DATED : April 24, 2001
INVENTOR(S) : Robert J. Witonsky et al.

It is certified that error appears in the above-identified patent and that said Letters Patent is hereby corrected as shown below:

Title page,
Title, delete "FORMULATE" and substitute therefor -- FORMULAE --.

ABSTRACT,
Delete "2. a shield according to claim 1 having;" and substitute therefor -- In a preferred embodiment the shield has --.

Column 6,
Line 49, delete "Ser.".

Column 9,
Line 11, delete"FIG. 3" and substitute therefor -- FIG. 4 --.

Column 10,
Line 51, delete "FIG. 5" and substitute therefor -- FIG. 3 --.

Column 11,
Line 32, delete "sec." and substitute therefor -- seconds --.
Line 64, after ")" substitute thereafter -- , --.

Column 14,
Line 5, delete "FIG. 7" and substitute therefor -- FIG. 6 --.
Line 37, delete "collar type" and substitute therefor -- collar-type --.
Line 41, delete "1" and substitute therefor -- 1° C --.
Line 44, delete "cross-sectional" and substitute therefor -- cross-sectional --.
Line 46, delete "insured" and substitute therefor -- ensured --.
Line 51, delete "water impervious" and substitute therefor -- water-impervious --.
Line 53, delete "reversed printed" and substitute therefor -- reversed-printed --.
Line 56, delete "8thermochromic" and substitute therefor -- thermochromic --.

UNITED STATES PATENT AND TRADEMARK OFFICE

CERTIFICATE OF CORRECTION

PATENT NO. : 6,222,168 B1
DATED : April 24, 2001
INVENTOR(S) : Robert J. Witonsky et al.

It is certified that error appears in the above-identified patent and that said Letters Patent is hereby corrected as shown below:

Column 15,
Line 13, delete "appraised" and substitute therefore -- apprised --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*